US006784782B2

(12) United States Patent
Inoue et al.

(10) Patent No.: US 6,784,782 B2
(45) Date of Patent: Aug. 31, 2004

(54) COMPOSITE MAGNETIC BODY, AND MAGNETIC ELEMENT AND METHOD OF MANUFACTURING THE SAME

(75) Inventors: Osamu Inoue, Osaka (JP); Junichi Kato, Osaka (JP); Nobuya Matsutani, Osaka (JP); Hiroshi Fujii, Osaka (JP); Takeshi Takahashi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/843,258

(22) Filed: Apr. 25, 2001

(65) Prior Publication Data

US 2002/0097124 A1 Jul. 25, 2002

(30) Foreign Application Priority Data

| | | |
|---|---|---|
| Apr. 28, 2000 | (JP) | 2000-131573 |
| Dec. 20, 2000 | (JP) | 2000-387743 |
| Feb. 5, 2001 | (JP) | 2001-027878 |

(51) Int. Cl.[7] ..... H01F 27/24

(52) U.S. Cl. ..... 336/233; 336/83; 336/90; 336/200

(58) Field of Search ..... 336/83, 212, 233, 336/90, 96, 200, 110; 428/307.3, 403, 693, 698

(56) References Cited

U.S. PATENT DOCUMENTS

| | | | | |
|---|---|---|---|---|
| 3,255,512 A | | 6/1966 | Lochner et al. | |
| 4,601,765 A | | 7/1986 | Soileau et al. | |
| 4,620,933 A | | 11/1986 | Ochiai et al. | |
| 5,350,628 A | * | 9/1994 | Kugimiya et al. | 336/110 |
| RE37,666 E | * | 4/2002 | Kanikiyo et al. | 148/302 |
| 6,509,821 B2 | | 1/2003 | Oldfield | |

FOREIGN PATENT DOCUMENTS

| | | |
|---|---|---|
| JP | 54-163354 | 12/1979 |
| JP | 61-136213 | 6/1986 |
| JP | 61-288403 | 12/1986 |
| JP | 63-136213 | 6/1988 |
| JP | 63-186409 | 8/1988 |
| JP | 1-253906 | 10/1989 |
| JP | 2-226799 | 10/1990 |
| JP | 2-254709 | 10/1990 |
| JP | 4-83320 | 3/1992 |
| JP | 6-342725 | 12/1994 |
| JP | 7-235410 | 9/1995 |
| JP | 9-102409 | 4/1997 |
| JP | 9-270334 | 10/1997 |

* cited by examiner

*Primary Examiner*—Tuyen T. Nguyen
(74) *Attorney, Agent, or Firm*—Merchant & Gould P.C.

(57) ABSTRACT

The present invention provides a composite magnetic body containing metallic magnetic powder and thermosetting resin and having a packing ratio of the metallic magnetic powder of 65 vol % to 90 vol % and an electrical resistivity of at least $10^4$ Ω·cm. When a coil is embedded in this composite magnetic body, a miniature magnetic element can be obtained that has a high inductance value and is excellent in DC bias characteristics.

29 Claims, 3 Drawing Sheets

COMPOSITE MAGNETIC BODY, AND MAGNETIC ELEMENT AND METHOD OF MANUFACTURING THE SAME

BACKGROUND OF THE INVENTION

1. Field of the Invention

The present invention relates generally to a composite magnetic body, further to a magnetic element such as an inductor, a choke coil, a transformer, or the like. Particularly, the present invention relates to a miniature magnetic element used under a large current and a method of manufacturing the same.

2. Related Background Art

With the reduction in size of electronic equipment, the reduction in size and thickness of components and devices used therein also has been demanded strongly. On the other hand, LSIs such as a CPU are used at higher speed and have higher integration density, and a current of several amperes to several tens of amperes may be supplied to a power circuit provided in the LSIs. Hence, similarly in an inductor, size reduction has been required, and in addition, it has been required to suppress heat generation caused by lowering the resistance of a coil conductor, although that is contrary to the size reduction, and to prevent the inductance from decreasing with DC bias. The operation frequency has come to be higher and it therefore has been required that the loss in a high frequency area be low. Furthermore, in order to reduce the manufacturing cost, it also has been requested that component elements with simple shapes can be assembled in easy processes. In other words, there has been demand for a miniaturized thinner inductor that can be used under a large current and at a high frequency and can be provided at low cost.

With respect to a magnetic body used for such an inductor, DC bias characteristics are improved with the increase in saturation magnetic flux density. Higher magnetic permeability allows a higher inductance value to be obtained but tends to cause magnetic saturation and thus, the DC bias characteristics are deteriorated. Hence, a desirable range of the magnetic permeability is selected depending on the intended use. In addition, it is desirable that the magnetic body have higher electrical resistivity and lower magnetic loss.

Magnetic materials that have been used practically are divided broadly into two types of ferrite (oxide) materials and metallic magnetic materials. The ferrite materials themselves have high magnetic permeability, low saturation magnetic flux density, high electrical resistance, and low magnetic loss. The metallic magnetic materials themselves have high magnetic permeability, high saturation magnetic flux density, low electrical resistance, and high magnetic loss.

An inductor that has been used most commonly is an element including an EE- or EI-type ferrite core and a coil. In this element, a ferrite material has high magnetic permeability and low saturation magnetic flux density. When the ferrite material is used without being modified, the inductance is decreased considerably due to the magnetic saturation, resulting in poor DC bias characteristics. Therefore, in order to improve the DC bias characteristics, usually such a ferrite core and a coil have been used with a gap provided in a magnetic path of the core to decrease the apparent magnetic permeability. However, when such a gap is provided, the core vibrates in the gap portion when being driven under an alternating current and thereby noise is generated. In addition, even when the magnetic permeability is decreased, the saturation magnetic flux density remains low. Consequently, the DC bias characteristics are not better than those obtained using metallic magnetic powder.

For example, a Fe—Si—Al based alloy or a Fe—Ni based alloy having higher saturation magnetic flux density than that of ferrite may be used as the core material. However, because such a metallic material has low electrical resistance, the increase in high operation frequency to several hundreds of kHz to MHz as in the recent situation results in the increase in eddy current loss and thus the inductor cannot be used without being modified. Accordingly, a composite magnetic body with magnetic powder dispersed in resin has been developed. The composite magnetic body can contain a coil. Hence, a larger cross sectional area of magnetic path can be obtained when using such a composite magnetic body.

In the composite magnetic body, an oxide magnetic body (ferrite) with high electrical resistivity may be used as a magnetic body. In this case, because the ferrite itself has high electrical resistivity, no problem is caused when a coil is contained in the composite magnetic body. However, when using the oxide magnetic body that cannot be deformed plastically, it is difficult to increase its packing ratio (filling rate). In addition, the oxide magnetic body inherently has a low saturation magnetic flux density. Thus, sufficiently good characteristics cannot be obtained even when the coil is embedded. On the other hand, when using metallic magnetic powder that can be deformed plastically and has high magnetic saturation flux density, the electrical resistivity of the metallic magnetic powder itself is low, and therefore the electrical resistivity of the whole magnetic body decreases due to contacts between powder particles with the increase in packing ratio. As described above, there has been a problem that the conventional composite magnetic body cannot have sufficiently good characteristics while maintaining high electrical resistivity.

SUMMARY OF THE INVENTION

The present invention is intended to provide a composite magnetic body that allows the problem of the above-mentioned conventional composite magnetic material to be solved, and to provide a magnetic element using the same. In addition, it also is an object of the present invention to provide a method of manufacturing a magnetic element using this composite magnetic body.

A composite magnetic body of the present invention contains metallic magnetic powder and thermosetting resin. The composite magnetic body is characterized by having a packing ratio of the metallic magnetic powder of 65 vol % to 90 vol % (preferably, 70 vol % to 85 vol %) and an electrical resistivity of at least $10^4$ Ω·cm. In the composite magnetic body of the present invention, the packing ratio of the metallic magnetic powder has been improved to a degree allowing good magnetic characteristics to be obtained while high electrical resistivity is maintained.

A magnetic element of the present invention is characterized by including the above-mentioned composite magnetic body and a coil embedded in the composite magnetic body. In addition, a method of manufacturing a magnetic element according to the present invention includes: obtaining a mixture including metallic magnetic powder and uncured thermosetting resin; obtaining a molded body by pressure-molding the mixture to embed a coil; and curing the thermosetting resin by heating the molded body.

DETAILED DESCRIPTION OF THE INVENTION

Figure 1:
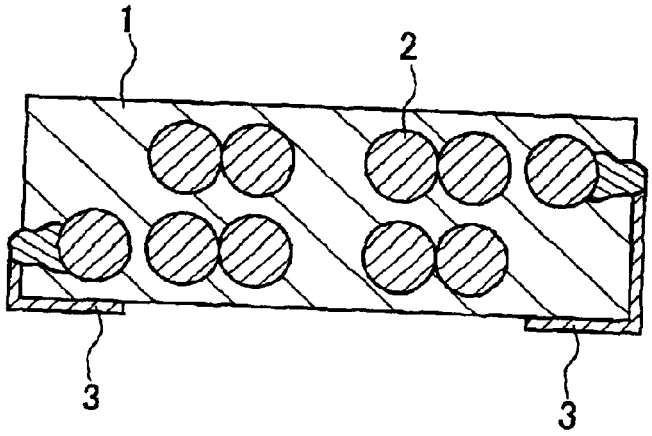
FIG. 1 is a sectional view showing an embodiment of a magnetic element according to the present invention.

Preferred embodiments of the present invention are described as follows.

First, the following description is directed to a composite magnetic body of the present invention.

Preferably, in the composite magnetic body of the present invention, the metallic magnetic powder contains a magnetic metal selected from Fe, Ni, and Co as a main component (at least 50 wt %) that preferably accounts for at least 90 wt % of the powder. It is further preferable that the metallic magnetic powder contain at least one non-magnetic element selected from Si, Al, Cr, Ti, Zr, Nb, and Ta. In this case, however, it is preferable that the total amount of the non-magnetic element be not more than 10 wt % of the metallic magnetic powder.

In the composite magnetic body of the present invention, electrical insulation can be maintained with the thermosetting resin alone. The composite magnetic body, however, may contain an electrical insulating material other than the thermosetting resin.

A preferable example of the electrical insulating material is an oxide film formed on the surface of the metallic magnetic powder. When the surface of the magnetic powder is covered with this oxide film, both high electrical resistivity and packing ratio can be obtained easily. Preferably, the oxide film contains at least one non-magnetic element selected from Si, Al, Cr, Ti, Zr, Nb, and Ta and has a thickness thicker than that of a natural oxide film (a spontaneously generated oxide film), for example, a thickness of 10 nm to 500 nm.

Another preferable example of the electrical insulating material is a material containing at least one selected from an organic silicon compound, an organic titanium compound, and a silica-based compound.

Still another preferable example of the electrical insulating material is a solid powder having a mean particle size not exceeding one tenth of that of the metallic magnetic powder.

Yet another preferable example of the electrical insulating material is plate- or needle-like particles. Particles with such a shape are advantageous in keeping both the electrical resistivity and packing ratio of the metallic magnetic powder high. Preferably, the particles are plate- or needle-like bodies with an aspect ratio of at least 3/1. In this case, the aspect ratio refers to the ratio of the largest diameter (the longest length) to the smallest diameter (the shortest length) of a particle. For example, the aspect ratio corresponds to a value obtained by dividing the largest diameter in an in-plane direction of a plate-like body by the plate thickness, or a value obtained by dividing the length of a needle-like body by its diameter. It is further preferable that a mean value of the largest diameters of the respective particles be 0.2 to 3 times the mean particle size of the metallic magnetic powder.

Preferably, the plate- or needle-like particles contain at least one selected from talc, boron nitride, zinc oxide, titanium oxide, silicon oxide, aluminum oxide, iron oxide, barium sulfate, and mica.

In addition, a material with lubricity (slippage) also is suitable as the electrical insulating material. Examples of such a material include at least one selected from fatty acid salt, fluororesin, talc, and boron nitride.

As described above, preferably, the composite magnetic body is formed of metallic magnetic powder, an electrical insulating material, and thermosetting resin (wherein the thermosetting resin also can serve as the electrical insulating material). The following description is directed to the respective materials of the composite magnetic body.

Initially, the metallic magnetic powder is described.

Specifically, Fe, a Fe—Si, Fe—Si—Al, Fe—Ni, Fe—Co, or Fe—Mo—Ni based alloy, or the like can be used as the metallic magnetic powder.

When using metal powder made of magnetic metal alone, sufficiently high electrical resistivity or withstand voltage may not be obtained in some cases. Hence, it is preferable to allow the metallic magnetic powder to contain a subsidiary component such as Si, Al, Cr, Ti, Zr, Nb, Ta or the like. This subsidiary component is contained in a concentrated state in a very thin spontaneous oxide film present at the surface. Consequently, the spontaneous oxide film slightly increases the resistance. Furthermore, the addition of the subsidiary component mentioned above also is preferable when the oxide film is formed by active heating of the metallic magnetic powder. When using Al, Cr, Ti, Zr, Nb, or Ta of the above-mentioned elements, rust resistance also is improved.

In such a case, an excessive amount of the subsidiary component other than the magnetic metal causes a decrease in saturation magnetic flux density and hardening of the powder itself. Hence, preferably, the total amount of the subsidiary component does not exceed 10 wt %, particularly, 6 wt %.

The metallic magnetic powder may contain trace components (for example, O, C, Mn, P, or the like) other than the elements described above as examples of the subsidiary component. Such trace components may originate from the raw material or may be mixed during a powder producing process. Such trace components are allowable as long as they do not hinder the achievement of the object of the present invention. Generally, a preferable upper limit of the amount of such trace components is about 1 wt %.

When consideration is given to the upper limit of the subsidiary component, a sendust composition (Fe-9.6% Si-5.4% Al) as a magnetic alloy used most commonly contains a slightly excessive amount of subsidiary components, although being not excluded from the materials used in the present invention.

Composition formulae in the present specification are indicated on a weight percent basis. In the composition formulae, the main component (ex. Fe in the sendust) is not indicated with a numerical value in accordance with common practice. Basically, however, this main component accounts for the rest of the total amount (although it is not intended to exclude trace components).

Preferably, the powder has a particle size of 1 to 100 $\mu$m, particularly 30 $\mu$m or smaller. This is because eddy current loss increases in the high frequency area when the powder has an excessively large particle size, and the strength tends to decrease when the composite body is made thinner. A pulverizing method may be used as a method of producing powder with particle sizes in the above-mentioned range. However, a gas or water atomization technique is preferable as it allows more uniform fine powder to be produced.

Next, the following description is directed to the electrical insulating material.

The electrical insulating material has no limitation in components, shape, or the like as long as it allows the object of the present invention to be achieved. Hence, the electrical insulating material may be replaced by the thermosetting resin described later. Preferably, however, (1) the electrical insulating material is formed to cover the surface of the metallic magnetic powder, or (2) the electrical insulating material is dispersed as powder (a powder dispersion method).

Both organic and inorganic materials can be used as the electrical insulating material to be formed to cover the surface of the metallic magnetic powder. When the organic material is used, a method may be used in which the organic material is added to the metallic magnetic powder to coat the powder (an additive coating method). On the other hand, when the inorganic material is used, the additive coating method may be used, but another method may be used in which the surface of the metallic magnetic powder is oxidized to be covered with an oxide film formed thereon (a self-oxidation method).

Examples of preferable organic materials include materials with excellent surface coatability with respect to the powder, for example, organic silicon compounds and organic titanium compounds. Examples of the organic silicon compounds include silicone resin, silicone oil, and a silane coupling agent. Examples of the organic titanium compounds include a titanium coupling agent, titanium alkoxide, and titanium chelate. Thermosetting resin may be used as the organic material. In this case, in order to obtain high electrical resistance, preferably, after the thermosetting resin is added to the metallic magnetic powder, the thermosetting resin is preheated to have a lower viscosity so as to have an increased coatability on the powder and to be semi-cured before main molding (main curing).

The material used for the additive coating method is not limited to the organic materials but may be suitable inorganic materials, for example, silica-based compounds such as water glass.

In the self-oxidation method, the oxide film on the surface of the metallic magnetic powder is used as an insulating material. This surface oxide film also is produced to some degree naturally but is too thin (generally, not thicker than 5 nm). It is difficult to obtain the required insulation resistance and withstand voltage with such a thin surface oxide film alone. Hence, in the self-oxidation method, the metallic magnetic powder is heated in an oxygen-containing atmosphere, for example, in the air, so that its surface is covered with an oxide film having a thickness of a few tens to several hundreds of nanometers, for example, 10 to 500 nm and thus the resistance and withstand voltage are increased. When using the self-oxidation method, it is particularly preferable to use metallic magnetic powder containing the above-mentioned component such as Si, Al, or Cr.

The powder of an electrical insulating material (electrical insulating particles) to be dispersed by the powder dispersion method has no limitation in composition or the like as long as it has the required electrical insulating property and reduces the probability that the particles of the metallic magnetic powder will come into contact with one another. However, particularly when using spherical or substantially spherical powder (for instance, powder including particles with an aspect ratio not exceeding 1.5/1), preferably, its mean particle size does not exceed one tenth (0.1 time) of the mean particle size of the metallic magnetic powder. When using such fine powder, the dispersibility increases and higher resistance can be obtained with a smaller amount of the powder. Consequently, when the resistance is the same, better characteristics can be obtained as compared to the case where such fine powder is not used.

The electrical insulating particles may have a spherical or another shape but preferably, is a plate- or needle-like shape. When using electrical insulating particles with such a shape, higher resistance can be obtained with a smaller amount of particles, or better characteristics can be obtained when the resistance is the same, as compared to the case of using spherical bodies. Specifically, it is preferable that the aspect ratio be at least 3/1, further 4/1, and particularly 5/1. On the contrary, larger aspect ratios such as 10/1 or 100/1 also are acceptable, but the upper limit of the aspect ratio obtained actually is about 50/1.

When the length of the longest portion of the plate- or needle-like particle is much shorter than the particle size of the metallic magnetic powder, only the same effect as that obtained in the case where spherical powder is mixed may be obtained in some cases. On the other hand, when the length of the longest portion is extremely long, the plate- or needle-like particles may be crushed during mixing with the metallic magnetic powder, or even if they are not crushed, higher pressure is required for obtaining a high packing ratio in a molding process.

Consequently, when using electrical insulating particles of plate- or needle-like powder, it is preferable to set their maximum length to be 0.2 to 3 times, further 0.5 time to twice the mean particle size of the metallic magnetic powder. When the maximum length is set to be substantially equal to the particle size of the metallic magnetic powder, the greatest effect of the additive can be expected.

The electrical insulating particles having such aspect ratios are not particularly limited. Examples of such particles include boron nitride, talc, mica, zinc oxide, titanium oxide, silicon oxide, aluminum oxide, iron oxide, and barium sulfate.

Even if the aspect ratio is not so high, when a material with lubricity is dispersed as the electrical insulating particles, a magnetic body with higher density can be obtained with the amount of the material to be added being unchanged. Examples of the electrical insulating particles a with lubricity include, specifically, fatty acid salt (for instance, stearate such as zinc stearate). In view of stability against environmental factors, however, fluororesin such as polytetrafluoroethylene (PTFE), talc, or boron nitride is preferable. Talc powder or boron nitride powder has a plate-like shape and lubricity and therefore is particularly suitable as the electrical insulating particles.

Preferably, the volume fraction of the electrical insulating particles in the whole magnetic body is 1 to 20 vol %, further preferably not higher than 10 vol %. An excessively low volume fraction results in excessively low electrical resistance. On the other hand, an excessively high volume fraction causes an excessive decrease in magnetic permeability and saturation magnetic flux density, resulting in disadvantages.

The additive coating method and self-oxidation method require a process of mixing the electrical insulating material in a liquid or fluid state and then drying it or a process of treating the electrical insulating material with heat at a high temperature for oxidation. In view of the manufacturing cost, therefore, the powder dispersion method has an advantage.

Finally, the thermosetting resin is described as follows.

The thermosetting resin hardens the whole composite magnetic body as a molded body and serves to allow a coil to be contained when an inductor is produced. For example, epoxy resin, phenol resin, or silicone resin can be used as the thermosetting resin. A trace amount of dispersant may be added to the thermosetting resin to improve its dispersibility with respect to the metallic magnetic powder. A small amount of plasticizer or the like also may be added suitably.

Preferable thermosetting resins are those whose principal components are in a solid powder or liquid state at ordinary temperature before being cured. As is often carried out, a resin present in a solid state at ordinary temperature may be dissolved in a solvent to be mixed with magnetic powder or the like and then the solvent may be evaporated. In order to sufficiently mix the resin present in a solution state with the powder, however, it is necessary to use a large amount of solvent. This increases the manufacturing cost and may cause environmental problems in some cases since this solvent must be removed eventually. When using a thermosetting resin whose principal component is in a solid powder state at ordinary temperature before being cured, the thermosetting resin can be mixed with the rest of the material containing metallic magnetic powder without being dissolved in a solvent.

When using a resin at least whose principal component is in a solid powder state at ordinary temperature before being cured, it is possible to store the thermosetting resin in a state where its principal component and a curing agent are mixed unevenly, before a main curing treatment. If the principal component and the curing agent are in an evenly mixed state, a curing reaction proceeds gradually even at room temperature to change the state of the powder. On the contrary, in the case where they are in an unevenly mixed state, even when they are left standing, the curing reaction proceeds only partially. Even in the case where they are in an unevenly mixed state, since viscosity of the solid-state resin decreases by heating and the solid-state resin is changed to a liquid state and is mixed uniformly, the curing reaction proceeds without a hitch in the main curing process. In order to achieve uniform mixing quickly upon heating, preferably, the solid-powder-state resin has a mean particle size not exceeding 200 $\mu$m. When it is difficult to carry out the grain production (granulation) described later, a thermosetting resin may be used in which the principal component is powder and a curing agent is a liquid at ordinary temperature.

A resin that is a liquid at ordinary temperature before being cured is softer than a solid-powder-state resin. Hence, such a resin allows a packing ratio by pressure-molding to increase easily and thus higher inductance to be obtained easily. Consequently, it is desirable to use a liquid-state resin to obtain good characteristics, and it is preferable to use a solid-powder-state resin (without being dissolved in a solvent) to obtain stable characteristics at low cost.

The mixture ratio between the thermosetting resin and the metallic magnetic powder may be determined according to the desired packing ratio of the metallic magnetic powder. Generally, the following relationship holds:

Thermosetting Resin (vol %)$\leqq$100−Metallic Magnetic Powder (vol %)−Electrical Insulating Material (vol %).

When the ratio of the thermosetting resin is excessively low, the strength of the magnetic body decreases. Hence, preferably, the ratio is at least 5 vol %, further preferably at least 10 vol %. On the other hand, it is necessary to set the ratio of the thermosetting resin to be 35 vol % or lower to obtain a packing ratio of the metallic magnetic powder of at least 65 vol %. However, further preferably, the ratio of the thermosetting resin is 25 vol % or lower.

The metallic magnetic powder that is mixed with a resin component may be molded without being treated further. However, when the powder is granulated to be granules by, for example, a method of passing the powder through a mesh, the flowability of the powder improves. When the powder is granulated to be granules, particles of the metallic magnetic powder are bonded gently to one another by means of the thermosetting resin and accordingly, the particle size becomes larger than the particle size of the metallic magnetic powder itself. Thus, the flowability improves. A preferable mean diameter of the granules is larger than that of the metallic magnetic powder, namely a few millimeters or smaller, for example, 1 mm or smaller. Most of the granules are deformed to lose their shape during the molding process.

It is preferable to heat the thermosetting resin during or after mixing with metallic magnetic powder to a temperature in a range between 65° C. and the main curing temperature of the thermosetting resin, namely generally a temperature not exceeding 200° C. although the main curing temperature varies depending on the resin. According to this pre-heating treatment, the viscosity of the resin decreases temporarily and the resin covers the metallic magnetic powder and the resin at the surfaces of the granules is brought into a semi-cured state. This improves the flowability of the granules and thus it can be carried out favorably, for instance, to introduce the mixture of the thermosetting resin and the metallic magnetic powder into a mold or to fill an inner side of a coil with the mixture. As a result, the magnetic property also improves. In addition, the particles of the metallic magnetic powder are prevented from coming into contact with one another during molding, and thus, higher electrical resistance can be obtained. Particularly, when a liquid-state resin is used without being treated further, the flowability of the powder is low due to the viscosity of the resin. It is therefore preferable to carry out the pre-heating treatment. Heating at a temperature lower than 65° C. hardly makes the viscosity of the resin lower or hardly allows the semi-curing reaction to proceed. The pre-heating treatment can be carried out regardless of whether before or after the granulation as long as it is carried out before molding and during or after the mixing of the metallic magnetic powder and resin.

The pre-heating treatment allows further higher resistance to be obtained when another electrical insulating material is contained. When no other electrical insulating material is contained, the pre-heating treatment allows the thermosetting resin itself also to serve as an electrical insulating material and thus an insulating property can be obtained. When the pre-curing proceeds excessively, however, it becomes difficult to increase the density in molding, or mechanical strength after the thermosetting resin is cured completely may decrease in some cases. The thermosetting resin therefore may be divided into two portions. Initially, one portion may be added for the formation of an insulating film and then the pre-heating treatment may be carried out; and the other portion may be mixed and the curing treatment may be completed.

The electrical insulating powder may be mixed with the metallic magnetic powder before being mixed with a resin component or all three components may be mixed together at a time. However, preferably, a part of the electrical insulating powder is pre-mixed with the metallic magnetic powder (a former mixing step) and the rest of the electrical insulating powder is mixed after the granulation carried out after mixing with the resin component (a latter mixing step). The mixing in this manner reduces the tendency of the electrical insulating powder to segregate. Accordingly, the probability that the particles of the metallic magnetic powder come into contact with one another can be lowered effectively. In addition, the lubricity of the electrical insulating powder added in the latter mixing step may increase the flowability of the granules to provide manageability. Hence, when the amount of the electrical insulating powder to be added is the same, higher resistance and inductance value are obtained easily as compared to the case where the mixing was not carried out in the above-mentioned manner. In this case, different types of electrical insulating powder may be added in the respective former and latter mixing steps. For example, when talc powder with high thermal stability may be added before the addition of the resin and a small amount of zinc stearate having low thermal stability but high lubricity may be added after the addition of the resin, an inductor having excellent stability and characteristics can be obtained. In this case, however, when an excessively large amount of electrical insulating powder is added after granulation, the mechanical strength of the molded body may decrease in some cases. Hence, preferably, the amount of the electrical insulating powder to be added after the addition of the resin is 30 wt % or less of the whole electrical insulating powder to be added.

Preferably, the mixture after granulated to have a granular shape is put into a mold and is pressure-molded so that a desired packing ratio of the metallic magnetic powder is obtained. When the packing ratio is increased excessively by application of higher pressure, the saturation magnetic flux density and magnetic permeability increase but the insulation resistance and withstand voltage tend to decrease. On the other hand, when the packing ratio is excessively low due to insufficient pressure application, the saturation magnetic flux density and magnetic permeability decrease and thus a sufficiently high inductance value and sufficiently good DC bias characteristics cannot be obtained. When the powder is added without plastically deformed, the packing ratio thereof does not reach 65%. With such a packing ratio, both the saturation magnetic flux density and magnetic permeability are excessively low. Hence, it is preferable to obtain a packing ratio of at least 65 vol %, more preferably at least 70 vol % through pressure-molding carried out so that at least a part of the metallic magnetic powder is deformed plastically.

The upper limit of the packing ratio is not particularly limited as long as an electrical resistivity of $10^4$ Ω·cm can be secured. When consideration is given to the lifetime of the mold, a desirable pressure for pressure-molding is 5 t/cm$^2$ (about 490 MPa) or lower. In view of these points, a preferable packing ratio is 90 vol % or lower, further preferably 85 vol % or lower, and a preferable pressure for molding is about 1 to 5 t/cm$^2$ (about 98 to 490 MPa), further preferably 2 to 4 t/cm$^2$ (about 196 to 392 MPa).

A molded body obtained by the pressure-molding is heated, so that the resin is cured. However, when the resin also is cured during the pressure-molding using a mold by being heated to the curing temperature of the thermosetting resin, it is easy to increase the electrical resistivity and cracks do not tend to be caused in the molded body. However, this method causes a decrease in manufacturing efficiency. Hence, when high productivity is desired, for example, the resin may be heated to be cured after pressure-molding carried out at room temperature.

Thus, a composite magnetic body can be obtained that has a packing ratio of the metallic magnetic powder of 65 to 90 vol %, an electrical resistivity of at least $10^4$ Ω·cm, and preferably, for example, a saturation magnetic flux density of at least 1.0 T and a magnetic permeability of about 15 to 100.

Next, examples of magnetic elements according to the present invention are described with reference to the drawings. The following description mainly is directed to an inductor used for a choke coil or the like. However, the present invention is not limited to this and may be applied, for instance, to a transformer requiring a secondary winding.

The magnetic element of the present invention includes the composite magnetic body described above and a coil embedded in this composite magnetic body. As in the case of using a general ferrite sintered body or a dust core, the above-mentioned composite magnetic body may be used by being processed to be, for example, an EE or EI type and being assembled together with a coil wound around a bobbin. However, when consideration is given to the fact that the magnetic permeability of the magnetic body according to the present invention is not so high, it is preferable that the element be formed with a coil embedded in the composite magnetic body.

In the magnetic element shown in FIG. 1, a conducting coil 2 is embedded in a composite magnetic body 1, and a pair of terminals 3 provided outside the magnetic body 1 are led out from both ends of the coil. On the other hand, each of the magnetic elements shown in FIGS. 2 to 4 further includes a second magnetic body 4, wherein a composite magnetic body 1 is used as a first magnetic body and the second magnetic body 4 has a higher magnetic permeability than that of the first magnetic body.

The second magnetic body 4 in each magnetic element is disposed so that a magnetic path 5 determined by a coil passes through both the composite magnetic body 1 and the second magnetic body 4. Generally, the magnetic path can be defined as a closed path in the element through which a main magnetic flux caused by a current passing through a coil goes. The magnetic flux goes through the inner and outer sides of the coil while passing through portions with high magnetic permeability. Thus, the arrangements shown in FIGS. 2 to 4 also can be defined, in other words, as the arrangements allowing no closed path going through the inner and outer sides of the coil via only the second magnetic body to be formed. With such arrangements, when the closed path formed by a main magnetic flux is allowed to pass through each of the composite magnetic body 1 and the second magnetic body 4 at least once, a larger cross sectional area of magnetic path can be secured and in addition, an optimum magnetic permeability according to the intended use can be obtained through adjustment of the magnetic path lengths in both.

Figure 2:
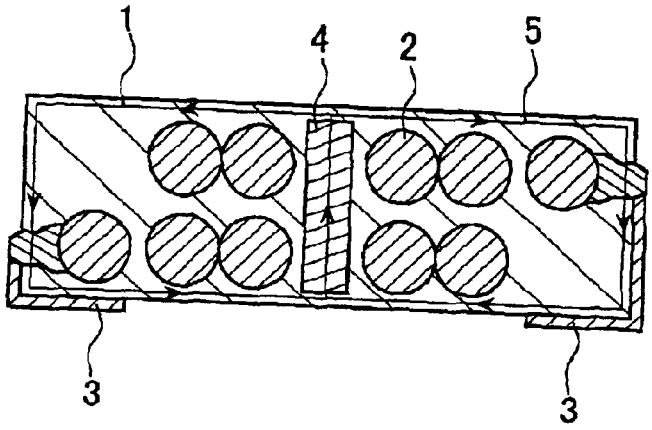
FIG. 2 is a sectional view showing another embodiment of a magnetic element according to the present invention.
Figure 3:
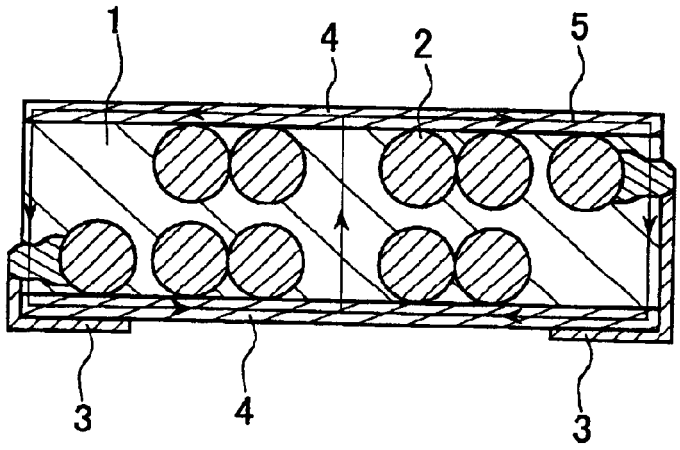
FIG. 3 is a sectional view showing still another embodiment of a magnetic element according to the present invention.

In the elements shown in FIGS. 1 to 3, the coil 2 is wound around an axis perpendicular to chip surfaces (upper and lower surfaces in the figures). In the element shown in FIG. 4, the coil 2 is wound around an axis parallel to the chip surfaces. In the former configuration, a larger cross sectional area of magnetic path can be obtained easily but it is difficult to increase the number of turns, and in the latter configuration, vice versa.

The elements shown in the figures as examples are assumed to be rectangular-plate-like inductance elements having a length of around 3 to 30 mm per side, a thickness of about 1 to 10 mm, and a ratio of the length of one side:the thickness=2:1 to 8:1. However, their dimensions are not limited to this and other shapes such as a disc-like shape also may be employed. Furthermore, how to wind the coil or the sectional shape of the lead wire also are not limited to those in the embodiments shown in the figures.

Figure 5:
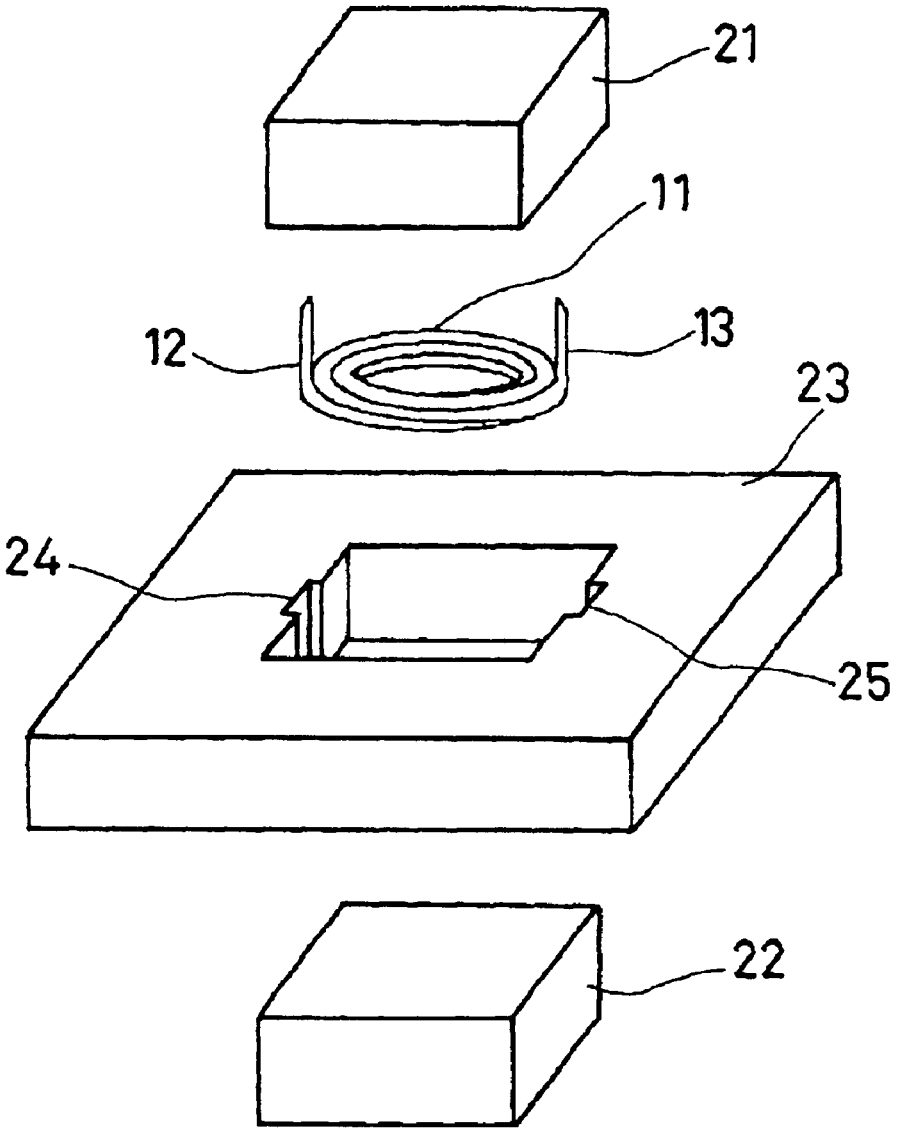
FIG. 5 is a perspective view showing an example of a method of manufacturing a magnetic element.

FIG. 5 is a perspective view for showing a process of assembly of the magnetic element shown in FIG. 1. In the embodiment shown in the figure, a round coated copper wire wound in two levels is used as a coil 11. Terminals 12 and 13 of the coil 11 are processed to be flat and are bent at substantially a right angle. Granules made of the metallic magnetic powder, electrical insulating material, and thermosetting resin described above are prepared. A part of the granules is put in a mold 23 in which a lower punch 22 has been inserted part way, and the granules are leveled to have a flat surface. In this case, pre-pressure-molding may be carried out at low pressure using an upper punch 21 and the lower punch 22. Next, the coil 11 is placed on the molded body in the mold so that the terminals 12 and 13 are inserted to cut portions 24 and 25 of the mold 23. Then, the granules further are put into the mold and then main pressure-molding is carried out with the upper and lower punches 21 and 22. A molded body thus obtained is removed from the mold and the resin component is cured by heating. Afterward, the ends of the terminals are processed again to be bent so as to be placed on the lower face of the element. Thus, the magnetic element shown in FIG. 1 can be obtained. The method of leading out the terminals is not limited to this and for example, the terminals may be led out separately from upper and lower sides.

Figure 4:
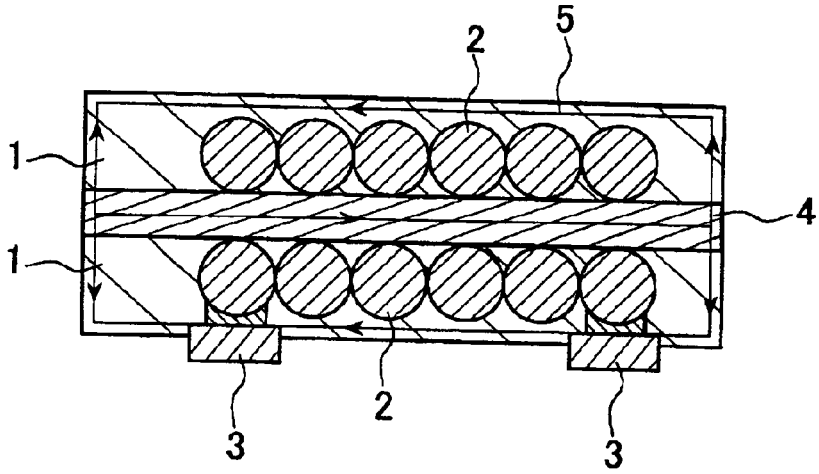
FIG. 4 is a sectional view showing yet another embodiment of a magnetic element according to the present invention.

Basically, the elements shown in FIGS. 2 to 4 also can be produced by the same method as described above. The element shown in FIG. 2 can be produced by using the second magnetic body 4 around which the coil 2 has been wound or by insertion of the second magnetic body 4 to the center of the coil 2 in molding. The element shown in FIG. 3 can be produced by the following method. That is, the second magnetic bodies 4 are disposed to come into contact with the upper and lower punches 21 and 22 in molding, or the second magnetic bodies 4 are bonded to the upper and lower faces of the pre-molded element. The element shown in FIG. 4 can be produced by using the second magnetic body 4 around which the coil 2 has been wound.

The shape of the conductor coil 2 may be selected suitably depending on the configuration, intended use, and required inductance and resistance. The conductor coil 2 may be formed of, for example, a round wire, a rectangular wire, or a foil-like wire. The material of the conductor is copper or silver, and generally, copper is preferable, since lower resistance is desirable. Preferably, the surface of the coil is coated with electrical insulating resin.

Preferable materials for the second magnetic bodies 4 are those with high magnetic permeability, high saturation magnetic flux density, and an excellent high frequency property. The materials that can be used for the second magnetic bodies 4 include at least one selected from ferrite and a dust core, specifically, a ferrite sintered body such as MnZn ferrite or NiZn ferrite, or a dust core formed as follows: Fe powder or metallic magnetic powder of, for example, a Fe—Si—Al based alloy or a Fe—Ni based alloy is solidified with a binder such as silicone resin or glass, which then is made dense to obtain a packing ratio of at least about 90%.

The ferrite sintered body has high magnetic permeability, is excellent in high frequency property, and can be manufactured at low cost, but has low saturation magnetic flux density. The dust core has high saturation magnetic flux density and secures a certain degree of high frequency property, but has lower magnetic permeability than that of the ferrite. Hence, the material for the second magnetic body 4 may be selected suitably from the ferrite sintered body and the dust core depending on the intended use. However, when consideration is given to the use under a large current, the dust core having high saturation magnetic flux density is preferable. The dust core itself has lower electrical resistance than that of the magnetic body of the present invention. Therefore, when the dust core is exposed at the surface, particularly at the lower surface of the element, it is necessary to electrically insulate this surface for some applications. When using the dust core, as shown in FIG. 2, it is preferable that the second magnetic body 4 be disposed so as not to be exposed at the surface (so as to be covered with the composite magnetic body 1). A combination of two magnetic bodies or more, for example, a combination of a NiZn ferrite sintered body and a dust core may be used as the first magnetic body.

The composite magnetic body of the present invention can have characteristics of both a conventional dust core and composite magnetic body. In other words, the composite magnetic body of the present invention has higher magnetic permeability and saturation magnetic flux density than those of the conventional composite material body and higher electrical resistance than that of the conventional dust core, and allows the cross sectional area of magnetic path to increase with the coil embedded in the composite magnetic body. Although it depends on the intended use, a magnetic body with better characteristics than those of the conventional dust core and composite magnetic body also can be obtained. Furthermore, when the composite magnetic body of the present invention is combined with the second magnetic body with higher magnetic permeability, effective magnetic permeability can be optimized, and thus a miniature magnetic element with good characteristics can be obtained. In addition, for its production, a powder molding process can be used. Hence, basically, only a curing treatment of the resin may be carried out at a temperature of one hundred and several tens of degrees during or after molding. Unlike the case of using the dust core, molding at high pressure and annealing at high temperature for providing good characteristics are not necessary. In addition, unlike the case of using the conventional composite magnetic body, it is not necessary to change the state of the material into a paste state and to handle it. Consequently, the element can be produced easily and the manufacturing cost required for the mass production process can be suppressed to a sufficiently low level.

EXAMPLES

The present invention is described further in detail by means of examples as follows, but is not limited to the following examples. In the following description, the unit "%" indicating the packing ratio denotes "vol %" in all the cases.

Example 1

Initially, Fe-3.5% Si powder (Fe accounts for the rest as described above) with a mean particle size of about 15 $\mu$m was prepared as a metallic magnetic powder. This powder was heated in the air at 550° C. for 10 minutes and thus an oxide film was formed on the surfaces of particles of the powder. In this process, the weight was increased by 0.7 wt %. The composition of the surface of a particle of the powder thus obtained was analyzed along a depth direction from the surface using Ar sputtering by Auger electron spectroscopy. As a result, a portion in the vicinity of the surface was an oxide film containing Si and O as main components and Fe partially, and the concentrations of Si and O decreased gradually toward the center of the particle. Then, the concentration of O became constant to have a value in a range that can be regarded as substantially zero and the original alloy composition was found that contained Fe as a main component and Si as a subsidiary component. Thus, it was confirmed that the surface of the particle was covered with an oxide film containing Si and O as main components and Fe partially. This oxide film had a thickness (of the region where the concentration gradient of O was observed in the above measurement) of about 100 nm.

Each amount, indicated in Table 1, of epoxy resin was added to this metallic magnetic powder, which then was mixed sufficiently. This mixture was granulated by being passed through a mesh. Next, this granulated powder was pressure-molded in a mold at various pressures around 3 t/cm$^2$ (about 294 MPa) and then was taken out from the mold. Afterward, it was heat-treated at 125° C. for one hour, so that the epoxy resin was cured. Thus, disc-shaped samples with a diameter of 12 mm and a thickness of 1 mm were obtained.

The density was calculated from the size and weight of each sample, then the packing ratio of the metallic magnetic powder was determined the density thus obtained and the amount of added resin. In view of the relationship between the packing ratio and the pressure, the molding pressure was adjusted so that the metal packing ratios indicated in Table 1 were obtained, and thus the respective samples were produced. For comparison, a sample also was produced in which no surface oxide film was formed on particles of the metallic magnetic powder.

On the upper and lower surfaces of each sample thus obtained, In—Ga electrodes were formed by an application method and the electrical resistivity between the upper and lower surfaces was measured at a voltage of 100V with electrodes pressed against the In—Ga electrodes. Next, the electrical resistance was measured while the voltage was increased by 100V at a time in a range up to 500V. The voltage at which the electrical resistance dropped abruptly was measured, and a voltage directly before the voltage thus measured was taken as the withstand voltage. Furthermore, a hole was formed in the center portion of another disc-shaped sample produced under the same conditions and winding was provided therein. Thus, a magnetic body was produced and its saturation magnetic flux density and relative initial magnetic permeability (relative initial permeability) at 500 kHz were measured. All the results are shown in Table 1.

TABLE 1

| No. | Oxide Film | Resin Amount (vol %) | Packing Ratio (vol %) | Electrical Resistivity (Ω · cm) | Withstand Voltage (V) | Sat. Mag. Flux Density *1 (T) | Relative Permeability | Ex. / C.Ex. *2 |
|---|---|---|---|---|---|---|---|---|
| 1 | Present | 10 | 60 | $>10^{11}$ | >500 | 1.2 | 7 | C.Ex. |
| 2 | Present | 35 | 60 | $>10^{11}$ | >500 | 1.2 | 7 | C.Ex. |
| 3 | Present | 30 | 65 | $10^{10}$ | >500 | 1.3 | 15 | Ex. |
| 4 | Present | 25 | 70 | $10^{9}$ | >500 | 1.4 | 22 | Ex. |
| 5 | Present | 20 | 75 | $10^{8}$ | >500 | 1.5 | 34 | Ex. |
| 6 | Present | 15 | 80 | $10^{7}$ | >500 | 1.6 | 43 | Ex. |
| 7 | Present | 10 | 85 | $10^{6}$ | 400 | 1.7 | 55 | Ex. |
| 8 | Present | 5 | 90 | $10^{4}$ | 200 | 1.8 | 66 | Ex. |
| 9 | Present | 2 | 95 | $<10^{2}$ | <100 | 1.9 | 79 | C.Ex. |
| 10 | Present | 0 | 75 | $10^{7}$ | 300 | 1.5 | 42 | C.Ex. |
| 11 | Absent | 20 | 75 | $<10^{2}$ | <100 | 1.5 | 56 | C.Ex. |

*1 Sat. Mag. Flux Density = Saturation Magnetic Flux Density
*2 Ex. / C.Ex. = Example / Comparative Example As is apparent from Table 1, when the oxide film was formed and the resin was mixed therewith, in the samples Nos. 1 and 2 with a packing ratio of lower than 65%, the relative magnetic permeability (relative permeability) was extremely low and the saturation magnetic flux density also was low regardless of the resin amount. On the other hand, in the sample No. 9 with a packing ratio of 95%, both the electrical resistivity and the withstand voltage were extremely low. On the contrary, the samples Nos. 3 to 8 with packing ratios of 65 to 90%, particularly, the samples Nos. 4 to 7 with packing ratios of 70 to 85% were excellent in the electrical resistivity, withstand voltage, saturation magnetic flux density, and magnetic permeability. The sample No. 8 with a packing ratio of 90% had disadvantages in that its electrical resistance and withstand voltage were lower than those of the samples Nos. 4 to 7 and its mechanical strength also was low although its saturation magnetic flux density and relative permeability were high. On the other hand, even with the same packing ratio of 75% as in the sample No. 5, the sample No. 10 with no resin mixed had slightly lower electrical resistivity and withstand voltage although having higher relative permeability. Furthermore, in the sample No. 10, the mechanical strength of the magnetic body itself was not obtained at all, and thus the magnetic body was not practically usable one. Even when the resin was added, the sample No. 11 with no oxide film formed had extremely low electrical resistivity and withstand voltage. Thus, usable characteristics were obtained only in the respective examples in which the oxide film was formed, the resin was added, and the packing ratio of metallic magnetic powder was 65 to 90%, more preferably 70 to 85%.

Example 2

Powders with the various compositions indicated in Table 2 with a mean particle size of 10 μm were prepared as a metallic magnetic powder. These powders were heat-treated in the air at temperatures indicated in Table 2 for 10 minutes. The temperatures allowing the weight of the powders to increase by about 1.0 wt % in the heat treatment were determined. Under such conditions, surface oxide films were formed. Epoxy resin was added to the powders thus obtained so that the epoxy resin accounted for 20 vol % of the whole amount, which then was mixed sufficiently. These were granulated by being passed through a mesh. Each of these granulated powders was molded in a mold at a predetermined molding pressure so that the final molded body had a packing ratio of the metallic magnetic powder of about 75%. Then, the molded body was taken out from the mold and then was heat-treated at 125° C. for one hour, so that the thermosetting resin was cured. Thus, a disc-shaped sample with a diameter of 12 mm and a thickness of 1 mm was obtained. The electrical resistivity, withstand voltage, saturation magnetic flux density, and relative permeability of the samples thus obtained were evaluated by the same methods as in Example 1. All the results are indicated in Table 2.

TABLE 2

| No. | Metallic Composition | Oxidizing Tempera -ture (° C.) | Molding Pressure (t/cm²) | Electrical Resistivity (Ω · cm) | Withstand Voltage (V) | Sat. Mag. Flux Density *1 (T) | Relative Permeability |
|---|---|---|---|---|---|---|---|
| 1 | Fe | 275 | 2.0 | $10^{5}$ | 400 | 1.6 | 20 |
| 2 | Fe—0.5%Si | 350 | 2.0 | $10^{6}$ | 400 | 1.6 | 21 |
| 3 | Fe—1.0%Si | 450 | 2.5 | $10^{8}$ | >500 | 1.6 | 24 |
| 4 | Fe—3.0%Si | 550 | 3.0 | $10^{10}$ | >500 | 1.5 | 29 |
| 5 | Fe—5.0%Si | 700 | 3.5 | $10^{11}$ | >500 | 1.4 | 32 |
| 6 | Fe—6.0%Si | 725 | 4.0 | $10^{11}$ | >500 | 1.4 | 34 |
| 7 | Fe—6.5%Si | 750 | 5.5 | $10^{10}$ | >500 | 1.4 | 35 |
| 8 | Fe—8.0%Si | 775 | 6.0 | $10^{9}$ | >500 | 1.3 | 33 |
| 9 | Fe—10%Si | 800 | 8.0 | $10^{7}$ | 400 | 1.1 | 31 |

TABLE 2-continued

| No. | Metallic Composition | Oxidizing Tempera -ture (° C.) | Molding Pressure (t/cm$^2$) | Electrical Resistivity (Ω · cm) | Withstand Voltage (V) | Sat. Mag. Flux Density *1 (T) | Relative Permeability |
|---|---|---|---|---|---|---|---|
| 10 | Fe—3.0%Al | 650 | 4.0 | $10^9$ | >500 | 1.5 | 23 |
| 11 | Fe—3.0%Cr | 700 | 4.5 | $10^8$ | >500 | 1.5 | 21 |
| 12 | Fe—4%Al—5%Si | 750 | 7.0 | $10^9$ | 400 | 1.2 | 37 |
| 13 | Fe—5%Al—10%Si | 800 | 8.0 | $10^8$ | 400 | 0.8 | 42 |
| 14 | Fe—60%Ni | 400 | 2.0 | $10^5$ | 400 | 1.1 | 36 |
| 15 | Fe—60%Ni—1%Si | 525 | 3.0 | $10^8$ | >500 | 1.1 | 36 |

*1 Sat. Mag. Flux Density = Saturation Magnetic Flux Density

As is apparent from Table 2, the samples Nos. 1 and 14 containing magnetic elements alone had a slightly lower electrical resistivity and withstand voltage although having greater weight increase by the oxidation than that in Example 1. When Si, Al, or Cr was added to these samples, both the electrical resistivity and withstand voltage were improved. When Si, Al, and Cr are compared with one another with reference to the samples Nos. 4, 10, and 11, in the cases where Al or Cr is added in the same amount as that of Si, a higher molding pressure is required, the magnetic permeability is relatively low, and the magnetic loss tends to be higher, which is not described herein. With respect to the amount of the non-magnetic element to be added, as is apparent from the samples Nos. 1 to 9, 12, and 13, the electrical resistivity and withstand voltage increases with the increase in the amount of the non-magnetic element, but the electrical resistance and withstand voltage tend to decrease after the amount exceeds 8%. In addition, since the heat-treatment temperature for oxidation and molding pressure must be high, the saturation magnetic flux density also decreases. Hence, preferably, the amount of the non-magnetic element to be added is 10% or less, further preferably 1 to 6%. Besides these samples, those with Ti, Zr, Nb, and Ta added thereto also were examined. When such elements were added, both the electrical resistivity and withstand voltage tended to be improved as compared with the cases where no such element was added although the characteristics were slightly inferior to those obtained when Si, Al, or Cr was added.

These samples were left standing for 240 hours at a high temperature and a high humidity, namely 70° C. and 90%, respectively. As a result, an effect of preventing rust from forming was found in the samples with Al, Cr, Ti, Zr, Nb, and Ta added thereto.

Example 3

In this example, Fe-1% Si powder with a mean particle size of 10 μm was prepared as a metallic magnetic powder. This powder was treated variously as indicated in Table 3. In other words, any one or combinations of two of the following pre-treatments were carried out: 1 wt % dimethylpolysiloxane, polytetrafluoroethylene, or water glass (sodium silicate) was added, which then was mixed sufficiently and was dried at 100° C., or oxidation was carried out to obtain weight increase by 1 wt % through heating in the air at 450° C. for 10 minutes. Next, epoxy resin was added to the pre-treated powder so that a volume ratio of the metallic magnetic powder to the resin of 85:15 was obtained, which then was mixed sufficiently. Afterward, the mixture was granulated by being passed through a mesh. With respect to these granulated powders, those pre-treated at 125° C. for 10 minutes and those without being pre-treated were prepared. Each of them was molded in a mold while pressure was varied so that a packing ratio of the metallic magnetic powder of 75% was obtained in the final molded body. After the molded body was taken out from the mold, a heat treatment was carried out at 125° C. for one hour to cure thermosetting resin completely. Thus, disc-shaped samples with a diameter of 12 mm and a thickness of 1 mm were obtained. The electrical resistivity, withstand voltage, and relative permeability of the samples thus obtained were evaluated by the same methods as in Example 1. All the results are shown in Table 3.

TABLE 3

| No. | Powder Pretreatment: First Treatment | Powder Pretreatment: Second Treatment | Treatment after Granulation | Electrical Resistivity (Ω · cm) | Withstand Voltage (V) | Relative Permeability | Ex. / C.Ex. *2 |
|---|---|---|---|---|---|---|---|
| 1 | None | None | None | $<10^3$ | <100 | 43 | C.Ex. |
| 2 | None | None | Pre-Heat | $>10^{11}$ | 100 | 31 | Ex. |
| 3 | Addition of Organic Si | None | None | $10^9$ | 100 | 33 | Ex. |
| 4 | Addition of Organic Ti | None | None | $10^9$ | 100 | 32 | Ex. |
| 5 | Addition of Water Glass | None | None | $10^8$ | 200 | 31 | Ex. |
| 6 | Oxid. Heat Treatment*1 | None | None | $10^7$ | >500 | 27 | Ex. |
| 7 | Oxid. Heat Treatment | Addition of Water Glass | None | $10^9$ | >500 | 23 | Ex. |

TABLE 3-continued

| No. | Powder Pretreatment First Treatment | Second Treatment | Treatment after Granulation | Electrical Resistivity (Ω · cm) | Withstand Voltage (V) | Relative Permeability | Ex. / C.Ex. *2 |
|---|---|---|---|---|---|---|---|
| 8 | Oxid. Heat Treatment | Addition of Organic Si | None | $10^{10}$ | >500 | 26 | Ex. |
| 9 | Oxid. Heat Treatment | Addition of Organic Ti | None | $10^{10}$ | >500 | 25 | Ex. |
| 10 | Addition of Organic Si | None | Pre-Heat | $>10^{11}$ | 200 | 29 | Ex. |
| 11 | Addition of Organic Ti | None | Pre-Heat | $>10^{11}$ | 200 | 28 | Ex. |
| 12 | Addition of Water Glass | None | Pre-Heat | $>10^{11}$ | 300 | 27 | Ex. |
| 13 | Oxid. Heat Treatment | None | Pre-Heat | $>10^{11}$ | >500 | 25 | Ex. |

*1 Oxid. Heat Treatment = Oxidation Heat Treatment
*2 Ex. / C.Ex. = Example / Comparative Example As is apparent from Table 3, higher withstand voltages were obtained in all the samples Nos. 2 to 6 in which any one of organic Ti, organic Si, and water glass was added, the oxidation heat-treatment was carried out, or the pre-heat-treatment was carried out after granulation, as compared to the sample No. 1 in which no treatment was carried out and thermosetting resin and metallic powder merely were mixed. In these samples, the samples Nos. 3 and 4 in which only the treatment with an organic element was carried out were high in the electrical resistivity but low in the withstanding voltage. On the other hand, the sample No. 5 in which only the treatment with an inorganic element was carried out tended to have relatively low electrical resistivity. Overall, the best of the samples Nos. 3 to 6 was the sample No. 6 in which the oxidation heat treatment was carried out. The samples Nos. 8 and 9 in which two treatments were carried out more excellent characteristics. In addition, the sample No. 7 in which both inorganic treatments of the oxidation treatment and the coating treatment were carried out also had better characteristics than those of the samples in which a single treatment was carried out. Furthermore, when the first and second treatments were carried out in reverse order in the samples Nos. 7 to 9, the electrical resistivity was decreased by the order of one digit, but substantially the same results were obtained in each sample.

Example 4

Three types of Fe-3% Si-3% Cr powders with mean particle sizes of 20 μm, 10 μm, and 5 μm were prepared as a metallic magnetic powder. To these Fe-3% Si-3% Cr powders, $Al_2O_3$ powders with respective mean particle sizes indicated in Table 4 were added, which were mixed sufficiently. Then, 3 wt % epoxy resin was added to each of the mixed powders, which then was sufficiently mixed and was granulated by being passed through a mesh. The granulated powder thus obtained was pressure-molded in a mold at a pressure of 4 t/cm$^2$ (about 392 MPa). The molded body was taken out from the mold and then was cured at 150° C. for one hour. Thus, disc-shaped samples with a diameter of about 12 mm and a thickness of about 1.5 mm were obtained. The density was calculated from the size and weight of each sample and then the packing ratios of the metallic magnetic body and $Al_2O_3$ in the whole sample were determined from the density value and the amounts of the $Al_2O_3$ powder and resin added. The electrical resistivity, withstand voltage, and relative initial permeability of the samples thus obtained were measured by the same methods as in Example 1. The results are shown in Table 4.

TABLE 4

| No. | Particle Size of Magnetic Body (μm) | Particle Size of $Al_2O_3$ (μm) | Amount of $Al_2O_3$ (vol %) | Packing Ratio of Magnetic Body (vol %) | Electrical Resistivity (Ω · cm) | Withstand Voltage (V) | Relative Permeability | Ex. / C.Ex. * |
|---|---|---|---|---|---|---|---|---|
| 1 | 10 | 5 | 5 | 76 | $<10^3$ | <100 | 35 | C.Ex. |
| 2 | 10 | 5 | 20 | 56 | $<10^3$ | <100 | 8 | C.Ex. |
| 3 | 10 | 2 | 5 | 76 | $<10^3$ | <100 | 33 | C.Ex. |
| 4 | 10 | 2 | 20 | 56 | $10^4$ | 100 | 7 | C.Ex. |
| 5 | 10 | 1 | 5 | 75 | $10^4$ | 100 | 30 | Ex. |
| 6 | 10 | 0.5 | 5 | 74 | $10^6$ | 200 | 28 | Ex. |
| 7 | 10 | 0.05 | 5 | 72 | $10^8$ | 200 | 22 | Ex. |
| 8 | 20 | 5 | 5 | 77 | $<10^3$ | 300 | 38 | C.Ex. |
| 9 | 20 | 2 | 5 | 77 | $10^4$ | 100 | 31 | Ex. |
| 10 | 20 | 1 | 5 | 76 | $10^5$ | 200 | 25 | Ex. |
| 11 | 5 | 1 | 5 | 74 | $<10^3$ | <100 | 32 | C.Ex. |
| 12 | 5 | 0.5 | 5 | 73 | $10^4$ | 100 | 26 | Ex. |
| 13 | 5 | 0.1 | 5 | 71 | $10^6$ | 200 | 22 | Ex. |

* Ex. / C.Ex. = Example / Comparative Example

As is apparent from Table 4, when the $Al_2O_3$ powder with a larger particle size was added to the magnetic powder with a mean particle size of 10 μm, even if the amount of the $Al_2O_3$ powder added was increased, the resistance was not increased. In the sample No. 4 in which 20 vol % $Al_2O_3$ powder with a particle size of 2 μm was added, a resistance on the order of $10^4$ Ω·cm was obtained, but the packing ratio of the metallic magnetic powder decreased and thus sufficiently high magnetic permeability was not obtained. On the other hand, in the samples Nos. 5 to 7 with $Al_2O_3$ powders having particle sizes of 1 μm or smaller, particularly in the samples Nos. 6 and 7 with $Al_2O_3$ powders having particle sizes of 0.5 μm or smaller, higher electrical resistance was obtained with a smaller amount of $Al_2O_3$ powder added. Consequently, the packing ratio of the metallic magnetic powder was increased and thus higher magnetic permeability was obtained.

On the other hand, a resistance value of $10^4$ Ω·cm was obtained the $Al_2O_3$ powder having a particle size of 2 μm or smaller when the magnetic powder had a particle size of 20 μm and with the $Al_2O_3$ powder having a particle size of 0.5 μm or smaller when the magnetic powder had a particle size of 5 μm. As described above, higher resistivities were obtained through the addition of electrical insulating material having particle sizes of one tenth, further preferably one twentieth of the mean particle size of the metallic magnetic powder.

Example 5

In this example, Fe-3% Si powder with a mean particle size of about 13 μm was prepared as a metallic magnetic powder. Plate-like boron nitride powder with a plate diameter of about 8 μm and a plate thickness of about 1 μm was added to the Fe-3% Si powder, which then was mixed sufficiently. Epoxy resin was added to this mixed powder, which then was mixed sufficiently and was granulated by being passed through a mesh. This granulated powder was pressure-molded in a mold under various pressures around 3 t/cm$^2$ (about 294 MPa). The molded body thus obtained was taken out from the mold and then was heat-treated at 150° C. for one hour, and thereby the thermosetting resin was cured. Thus, disc-shaped samples with a diameter of about 12 mm and a thickness of about 1.5 mm were obtained. The density was calculated from the size and weight of each sample, and the packing ratio of the metallic magnetic powder was determined from the density value thus obtained and the amounts of mixed boron nitride and resin. Thus, the samples were produced through adjustments of the amounts of boron nitride and resin and the molding pressure so that the amount of boron nitride was 3 vol % and the metal packing ratios were those indicated in Table 5. For comparison, a sample with boron nitride added thereto also was produced. The resistivity, withstand voltage, and relative initial permeability of the samples thus obtained were measured by the same methods as in Example 1. The results are shown in Table 5.

TABLE 5

| No. | Boron Nitride | Resin Amount (vol %) | Packing Ratio (vol %) | Electrical Resistivity (Ω · cm) | Withstand Voltage (V) | Sat. Mag. Flux Density *1 (T) | Relative Permeability | Ex. / C.Ex. *2 |
|---|---|---|---|---|---|---|---|---|
| 1 | Present | 10 | 60 | $>10^{11}$ | >400 | 1.2 | 5 | C.Ex. |
| 2 | Present | 35 | 60 | $>10^{11}$ | >400 | 1.2 | 6 | C.Ex. |
| 3 | Present | 30 | 65 | $10^9$ | >400 | 1.3 | 12 | Ex. |
| 4 | Present | 25 | 70 | $10^8$ | >400 | 1.4 | 18 | Ex. |
| 5 | Present | 20 | 75 | $10^7$ | >400 | 1.5 | 24 | Ex. |
| 6 | Present | 15 | 80 | $10^6$ | >400 | 1.6 | 35 | Ex. |
| 7 | Present | 10 | 85 | $10^5$ | 300 | 1.7 | 47 | Ex. |
| 8 | Present | 5 | 90 | $10^4$ | 200 | 1.8 | 52 | Ex. |
| 9 | Present | 2 | 93 | $<10^2$ | <100 | 1.9 | 60 | C.Ex. |
| 10 | Present | 0 | 75 | $10^6$ | 200 | 1.5 | 28 | C.Ex. |
| 11 | Absent | 20 | 75 | $<10^2$ | <100 | 1.5 | 38 | C.Ex. |

*1 Sat. Mag. Flux Density = Saturation Magnetic Flux Density
*2 Ex. / C.Ex. = Example / Comparative Example As is apparent from Table 5, when the boron nitride was added and the resin was mixed therewith, the samples Nos. 1 and 2 with packing ratios of less than 65% had extremely low relative permeability and low saturation magnetic flux density, regardless of the resin amount. On the other hand, in the sample No. 9 with a packing ratio of 93%, both the electrical resistivity and withstand voltage were decreased considerably. On the contrary, the samples Nos. 3 to 8 with packing ratios of 65 to 90%, particularly the sample Nos. 4 to 7 with packing ratios of 70 to 85% were excellent in all the electrical resistivity, withstand voltage, saturation magnetic flux density, and magnetic permeability. The sample No. 8 with a packing ratio of 90% had a high saturation magnetic flux density and relative permeability but had the following disadvantages. That is, the sample No. 8 had a lower resistance and withstand voltage than those of the samples Nos. 4 to 7 and had low mechanical strength due to a small amount of resin. On the other hand, even with the same packing ratio of 75% as that of the sample No. 5, the sample No. 10 with no resin added thereto was high in the relative permeability but slightly lower in the electrical resistivity and withstand voltage. In addition, the mechanical strength of the magnetic body itself was not obtained at all in the sample No. 10, and thus the magnetic body was not a practically usable one. Even when the resin was mixed, the sample No. 11 with no boron nitride added and mixed had extremely low electrical resistivity and withstand voltage. Thus, usable characteristics were obtained only in the examples in which boron nitride was added, resin was mixed, and the packing ratio of the metallic magnetic powder was 65 to 90%, more preferably 70 to 85%.

Example 6

In this example, Fe-2% Si powder with a mean particle size of about 10 μm was prepared as a metallic magnetic powder. Various plate-like powders with a plate diameter of about 10 μm and a plate thickness of about 1 μm or a needle-like powder with a needle length of about 10 μm and a needle diameter of about 2 μm, as indicated in Table 6, and epoxy resin were mixed with the Fe-2% Si powder. By the same methods as in Example 1, disc-shaped samples with a diameter of about 12 mm and a thickness of about 1.5 mm were obtained that had a packing ratio of the metallic magnetic powder of 75% and volume percentages of the various plate- or needle-like powders shown in Table 6. For comparison, additional disc-shaped samples also were produced using spherical additives with a particle size of 10 μm. The electrical resistivity, withstand voltage, and relative permeability of the samples thus obtained were evaluated by the same methods as in Example 1. The results are shown in Table 6.

TABLE 6

| No. | Type of Additive | Amount of Additive (vol %) | Amount of Resin (vol %) | Electrical Resistivity (Ω · cm) | Withstand Voltage (V) | Relative Permeability | Ex. / C.Ex. * |
|---|---|---|---|---|---|---|---|
| 1 | None | 0 | 20 | $<10^2$ | <100 | 43 | C.Ex. |
| 2 | $SiO_2$ (plate) | 0.5 | 20 | $10^3$ | 100 | 33 | C.Ex. |
| 3 | $SiO_2$ (plate) | 1 | 20 | $10^6$ | 200 | 30 | Ex. |
| 4 | $SiO_2$ (plate) | 3 | 20 | $10^7$ | >400 | 25 | Ex. |
| 5 | $SiO_2$ (plate) | 5 | 18 | $10^8$ | >400 | 21 | Ex. |
| 6 | $SiO_2$ (plate) | 10 | 13 | $10^{10}$ | >400 | 13 | Ex. |
| 7 | $SiO_2$ (plate) | 15 | 8 | $10^{11}$ | >400 | 6 | Ex. |
| 8 | ZnO (plate) | 3 | 20 | $10^6$ | 300 | 20 | Ex. |
| 9 | $TiO_2$ (plate) | 3 | 20 | $10^6$ | 300 | 22 | Ex. |
| 10 | $Al_2O_3$ (plate) | 3 | 20 | $10^5$ | 200 | 23 | Ex. |
| 11 | $Fe_2O_3$ (needle) | 3 | 20 | $10^5$ | 200 | 27 | Ex. |
| 12 | BN (plate) | 3 | 20 | $10^7$ | >400 | 24 | Ex. |
| 13 | $BaSO_4$ (plate) | 3 | 20 | $10^6$ | 300 | 23 | Ex. |
| 14 | Talc (plate) | 3 | 20 | $10^5$ | 200 | 25 | Ex. |
| 15 | Mica (plate) | 3 | 20 | $10^5$ | 200 | 21 | Ex. |
| 16 | $SiO_2$ (spherical) | 10 | 13 | $<10^2$ | <100 | 33 | C.Ex. |
| 17 | $Al_2O_3$ (spherical) | 10 | 13 | $<10^2$ | <100 | 26 | C.Ex. |

* Ex. / C.Ex. = Example / Comparative Example

As is apparent from Table 6, the samples Nos. 2 to 7 with plate-like $SiO_2$ added thereto had higher resistance and withstand voltage than those of the sample No. 1 with no additive. However, the sample No. 2 with the additive added in an amount of less than 1 vol % did not have sufficiently high resistance and withstand voltage. On the other hand, the sample No. 7 with the additive added in an amount exceeding 10 vol % had an extremely low magnetic permeability. In addition, the molding pressure required for obtaining a packing ratio of the metallic magnetic powder of 75% was very high although it is not described herein. Hence, it is desirable that the amount of plate-like $SiO_2$ to be added be 10 vol % or less, more desirably 1 to 5 vol %. Besides $SiO_2$, all the samples Nos. 8 to 15 in which 3 vol % plate- or needle-like ZnO, $TiO_2$, $Al_2O_3$, $Fe_2O_3$, BN, $BaSO_4$, talc, or mica powder was added had higher resistance and withstand voltage. With respect to these powders, the inventors examined mixture ratios of various volume percentages other than those indicated in Table 6. After all, however, the amount of 10 vol % or less, more desirably 1 to 5 vol % allowed well balanced results to be obtained with respect to the electrical resistivity, withstand voltage, and the magnetic permeability. However, even when using the same $SiO_2$ or $Al_2O_3$, in the samples Nos. 16 and 17 with spherical powders added thereto, the measurement results hardly show the effect of increasing the resistance.

Example 7

Powders with various compositions indicated in Table 7 with a mean particle size of about 16 μm were prepared as a metallic magnetic powder. To These powders, plate-like $SiO_2$ powders with a plate diameter of about 10 μm and a plate thickness of about 1 μm and epoxy resin were added, which then was mixed sufficiently. By the same methods as in Example 1, cured disc-shaped samples with a diameter of about 12 mm and a thickness of about 1.5 mm were obtained that had volume fractions of the metallic magnetic powder, resin, and $SiO_2$ in the final molded bodies of about 75%, 20% and 3%. The electrical resistivity, withstand voltage, saturation magnetic flux density, and relative permeability of the samples thus obtained were evaluated by the same methods as in Example 1. The results are shown in Table 7.

TABLE 7

| No. | Metallic Composition | Electrical Resistivity (Ω · cm) | Withstand Voltage (V) | Sat. Mag. Flux Density *1 (T) | Relative Permeability | Ex. / C.Ex. *2 |
|---|---|---|---|---|---|---|
| 1 | Fe | $10^4$ | 200 | 1.6 | 15 | Ex. |
| 2 | Fe—0.5%Si | $10^5$ | 300 | 1.6 | 19 | Ex. |
| 3 | Fe—1.0%Si | $10^6$ | >400 | 1.6 | 21 | Ex. |
| 4 | Fe—3.0%Si | $10^7$ | >400 | 1.5 | 24 | Ex. |
| 5 | Fe—5.0%Si | $10^8$ | >400 | 1.4 | 25 | Ex. |
| 6 | Fe—6.0%Si | $10^8$ | >400 | 1.4 | 26 | Ex. |
| 7 | Fe—6.5%Si | $10^8$ | >400 | 1.4 | 27 | Ex. |
| 8 | Fe—8.0%Si | $10^9$ | >400 | 1.3 | 25 | Ex. |

TABLE 7-continued

| No. | Metallic Composition | Electrical Resistivity (Ω · cm) | Withstand Voltage (V) | Sat. Mag. Flux Density *1 (T) | Relative Perme-ability | Ex. / C.Ex. *2 |
|---|---|---|---|---|---|---|
| 9 | Fe—10%Si | $10^8$ | 300 | 1.1 | 23 | Ex. |
| 10 | Fe—3.0%Al | $10^6$ | >400 | 1.5 | 20 | Ex. |
| 11 | Fe—3.0%Cr | $10^6$ | >400 | 1.5 | 19 | Ex. |
| 12 | Fe—4%Al—5%Si | $10^9$ | >400 | 1.2 | 26 | Ex. |
| 13 | Fe—5%Al—10%Si | $10^8$ | 300 | 0.8 | 26 | Ex. |
| 14 | Fe—60%Ni | $10^4$ | 200 | 1.1 | 28 | Ex. |
| 15 | Fe—60%Ni—1%Si | $10^6$ | >400 | 1.1 | 26 | Ex. |

*1 Sat. Mag. Flux Density = Saturation Magnetic Flux Density
*2 Ex./ C.Ex. = Example / Comparative Example As is apparent from Table 7, the samples Nos. 1 and 14 containing magnetic elements alone had relatively low electrical resistivity and withstand voltage. When Si, Al, or Cr was added thereto, both the electrical resistivity and withstand voltage were improved. When Si, Al, and Cr were compared with one another with reference to the samples Nos. 4, 10, and 11, in the cases where Al or Cr was added, the magnetic permeability was slightly lower, and higher molding pressure was required to obtain the same level of packing ratio of the metallic magnetic body and the magnetic loss tended to be higher, which are not described herein. With respect to the amount of non-magnetic element to be added, as is apparent from the samples Nos. 1 to 9, 12, and 13, the electrical resistivity and withstand voltage increased with the increase in the amount of non-magnetic element, but after the amount exceeded 10 wt %, the saturation magnetic flux density was decreased and the molding pressure required to obtain the same level of packing ratio of the metallic magnetic body was increased, although this is not described herein. Consequently, it is preferable that the amount of non-magnetic element be 10 wt % or less, further preferably 1 to 5 wt %.

Example 8

In this example, Fe-4% Al powder with a mean particle size of about 13 μm was prepared as a metallic magnetic powder. To this powder, spherical polytetrafluoroethylene (PTFE) powder was added as solid powder with lubricity, which then was mixed sufficiently. Epoxy thermosetting resin was added to this mixed powder, which then was mixed sufficiently. Afterward, the mixture was heated at 70° C. for one hour and then was granulated by being passed through a mesh. This granulated powder was pressure-molded in a mold at various pressures around 3 t/cm$^2$ (about 294 MPa) and the molded body thus obtained was removed from the mold. Afterward, the molded body was heat-treated at 150° C. for one hour, so that the thermosetting resin was cured. Consequently, disc-shaped samples with a diameter of about 12 mm and a thickness of about 1.5 mm were obtained. The density was calculated from the size and weight of each sample and then the packing ratio of the metallic magnetic powder was determined from the density value thus obtained and the amounts of mixed PTFE and resin. Thus, the samples were manufactured so that the packing ratios of PTFE and metal indicated in Table 8 were obtained through adjustments of the PTFE amount, resin amount, and molding pressure. For comparison, samples with no PTFE mixed thereto also were produced. The electrical resistivity, withstand voltage, and relative initial permeability of the samples thus obtained were measured by the same methods as in Example 1. The results are shown in Table 8.

TABLE 8

| No. | PTFE (vol %) | Resin Amount (vol %) | Metal (vol %) | Electrical Resistivity (Ω · cm) | With-stand Voltage (V) | Sat. Mag. Flux Density *1 (T) | Relative Perme-ability | Ex. / C.Ex. *2 |
|---|---|---|---|---|---|---|---|---|
| 1 | 0 | 35 | 60 | $>10^9$ | 100 | 1.2 | 6 | C.Ex. |
| 2 | 10 | 25 | 60 | $>10^{11}$ | >400 | 1.2 | 4 | C.Ex. |
| 3 | 10 | 20 | 65 | $10^8$ | >400 | 1.3 | 12 | Ex. |
| 4 | 10 | 15 | 70 | $10^7$ | >400 | 1.4 | 22 | Ex. |
| 5 | 0 | 20 | 75 | $<10^2$ | <100 | 1.5 | 35 | C.Ex. |
| 6 | 1 | 20 | 75 | $10^4$ | 200 | 1.5 | 33 | Ex. |
| 7 | 10 | 10 | 75 | $10^5$ | 300 | 1.5 | 26 | Ex. |
| 8 | 15 | 5 | 75 | $10^5$ | 300 | 1.5 | 15 | Ex. |
| 9 | 20 | 2 | 75 | $10^6$ | >400 | 1.5 | 7 | Ex. |
| 10 | 5 | 5 | 85 | $10^6$ | 200 | 1.6 | 38 | Ex. |
| 11 | 1 | 5 | 90 | $10^4$ | 100 | 1.8 | 54 | Ex. |
| 12 | 1 | 3 | 92 | $<10^2$ | <100 | 1.8 | 66 | C.Ex. |

*1 Sat. Mag. Flux Density = Saturation Magnetic Flux Density
*2 Ex./ C.Ex. = Example / Comparative Example As is apparent from Table 8, when the packing ratio of the metallic magnetic powder was 60%, the initial resistance was high even in the case where no PTFE was added, but the withstand voltage was low (No. 1). When PTFE was added to the sample No. 1, the withstand voltage increased (No. 2), but the saturation magnetic flux density and magnetic permeability were low. When the packing ratio of the metallic magnetic powder was increased gradually to 85%, the magnetic permeability and saturation magnetic flux density tended to increase and the resistance and withstand voltage to decrease. However, when the amount of PTFE was set to be 1 to 15% a resistance of at least $10^5$ Ω and a withstand voltage of at least 200V were obtained (Nos. 3, 4, 6, 7, 8, and 10). However, the sample No. 5 with no PTFE added thereto was low both in the resistance and withstand voltage. On the contrary, the sample no. 9 with 20 vol % PTFE had low magnetic permeability. Preferably, the amount of PTFE to be added is 1 to 15 vol % In this example, when the packing ratio of the metallic magnetic powder exceeded 90%, the volume percentages of PTFE and resin became lower inevitably, and thus, the resistance and withstand voltage were decreased and the mechanical strength also was decreased.

For comparison, samples also were produced in which spherical alumina powder with no lubricity was added. However, in such samples, the resistance hardly increased when the alumina powder was added in an amount of 20 vol % or less.

Example 9

In this example, 49% Fe-49% Ni-2% Si powder with a mean particle size of 15 μm was prepared as a metallic magnetic powder. This powder was heated in the air at 500° C. for ten minutes, and thus an oxide film was formed on the surfaces of particles of the powder. In this oxidation process, the weight was increased by 0.63 wt %. To the powder thus obtained, epoxy resin was added so that a volume ratio of the metallic magnetic powder to the resin of 77:23 was obtained, which then was mixed sufficiently and granulated by being passed through a mesh. Next, a 4.5-turn coil with two levels whose inner diameter was 5.5 mm was prepared using a coated copper wire with a 1-mm diameter. As shown in FIG. 5, a part of the granulated powder was put in a mold 12.5 mm square and was leveled by gentle pressing. Afterward, the coil was placed thereon and further the powder was put thereon, which then was pressure-molded at a pressure of 3.5 t/cm$^2$ (about 343 MPa). The molded body was removed from the mold and was heat-treated at 125° C. for one hour, and thereby the thermosetting resin was cured. The molded body thus obtained had a size of 12.5×12.5×3.4 mm and a packing ratio of metallic powder of 73%. Inductances of this magnetic element measured at 0 A and 30 A were high, namely 1.2 μH and 1.0 μH, respectively, and had low current value dependence. The electrical resistance of the coil conductor was 3.0 mΩ.

Example 10

In this example, 97% Fe-3% Si powder with a mean particle size of about 15 μm was prepared as a metallic magnetic powder. This powder was heated in the air at 525° C. for ten minutes, and thus an oxide film was formed on the surfaces of particles of the powder. In this oxidation process, the weight was increased by 0.63 wt %. To the powder thus obtained, epoxy resin was added so that a volume ratio of the metallic magnetic powder to the resin of 85:15 was obtained, which then was mixed sufficiently and granulated by being passed through a mesh. With this granulated powder, by the same method as in Example 9, a magnetic element was produced that had a size of 12.5×12.5×3.4 mm and a packing ratio of metallic magnetic powder of 76%. Inductances of this magnetic element measured at 0 A and 30 A were high, namely 1.4 μH and 1.2 μH, respectively, and had low current value dependence. The electrical resistance of the coil conductor was 3.0 mΩ.

Example 11

In this example, Fe-4% Si powder with a mean particle size of about 10 μm was prepared as a metallic magnetic powder. This powder was heated in the air at 550° C. for 30 minutes, and thereby an oxide film was formed on the surfaces of particles of the powder. To the powder thus obtained, epoxy resin was added so that a volume ratio of the metallic magnetic powder to the resin of 77:23 was obtained, which then was mixed sufficiently and granulated by being passed through a mesh. Next, silicone resin was added to 50% Fe-50% Ni powder with a particle size of about 20 μm. This was molded at a pressure of 10 t/cm$^2$ (about 980 MPa) and then was annealed in nitrogen. Thus, a dust core was prepared that had a filling density of 95%, a diameter of 5 mm, and a thickness of 2 mm. A coil was made of 4.5 turns of a 1-mm diameter coated copper wire wound in two levels around the dust core. Using this coil having the dust core as its core and the granulated powder, the powder and the conductor with the dust core were molded integrally by the same method as in Example 9. The molded body was heat-treated at 125° C. for one hour and thereby the thermosetting resin was cured. Thus, a molded body with the same configuration as that shown in FIG. 2 was obtained. The molded body thus obtained had a size of 12.5×12.5×3.5 mm. Inductances of this magnetic element measured at 0 A and 30 A were further higher than those in Example 9 using no dust core, namely 2.0 μH and 1.5 μH, respectively, and had low current value dependence. The electrical resistance of the coil conductor was 3.0 mΩ.

Example 12

In this example, Fe-3.5% Si powder with a mean particle size of 15 μm was prepared as a metallic magnetic powder. To this powder, plate-like boron nitride powder with a plate diameter of about 10 μm and a plate thickness of about 1 μm and epoxy resin were added so that a volume ratio of the metallic magnetic powder: the boron nitride: the resin= 76:20:4 was obtained, which then was mixed sufficiently and was granulated by being passed through a mesh. Next, a 4.5 turn coil with two levels whose inner diameter was 5.5 mm was prepared using a 1-mm diameter coated copper wire. This coil and the granulated powder were pressure-molded by the same method as in Example 9. The molded body was taken out from the mold and then was heat-treated at 150° C. for one hour, and thereby the thermosetting resin was cured. The molded body thus obtained had a size of 12.5× 12.5×3.4 mm and a packing ratio of the metallic magnetic powder of 74%. Inductances of this magnetic element measured at 0 A and 30 A were high, namely 1.5 μH and 1.1 μH, respectively, and had low current value dependence. Next, a coil terminal and an element outer face, and two places on the element outer face were clamped with alligator clips, respectively. Then, the electrical resistances between the coil terminal and the element outer face and between the two points on the element outer face were measured. As a result, in both the cases, a resistance of at least $10^{10}$ Ω was obtained and the withstand voltage was at least 400V. Thus, the coil terminal and the element outer face and the two points on the element outer surface were electrically insulated perfectly from each other. The electrical resistance of the coil conductor itself was 3.0 mΩ.

Example 13

In this example, Fe-1.5% Si powder with a mean particle size of 10 μm was prepared as a metallic magnetic powder. To this powder, plate-like boron nitride powder with a plate diameter of about 10 μm and a plate thickness of about 1 μm and epoxy resin were added so that a volume ratio of the metallic magnetic powder: the resin: the boron nitride= 77:20:3 was obtained, which then was mixed sufficiently and was granulated by being passed through a mesh. Next, a one turn coil with an inner diameter of 4 mm was prepared using a 0.7-mm diameter coated copper wire. With this coil and the granulated powder, a magnetic element with a size of 6×6×2 mm was produced by the same method as in Example 12. Inductances of this magnetic element measured at 0 A and 30 A were high, namely 0.16 μH and 0.13 μH, respectively, and had low current value dependence. Next, a coil terminal and an element outer face, and two places on the element outer face were clamped with alligator clips, respectively. Then, the electrical resistances between the coil terminal and the element outer face and between two points of the element outer face were measured. As a result, in both the cases, a resistance of at least $10^{10}$ Ω was obtained and in addition, the withstand voltage was at least 400V. Thus, the coil terminal and the element outer face and the two points on the element outer surface were electrically insulated perfectly from each other. The electrical resistance of the coil conductor itself was 1.3 mΩ.

Example 14

There were prepared Fe-3.5% Al powder with a mean particle size of 10 μm as a metallic magnetic powder, talc powder, epoxy resin, and zinc stearate powder. Initially, the metallic magnetic powder and the talc powder were mixed sufficiently and the epoxy resin was added thereto, which further was mixed. This mixture was heated at 70° C. for one hour and then was granulated by being passed through a mesh. Then, the zinc stearate was added to and mixed with this granulated powder. In this case, the volume fraction of the metallic magnetic powder: the talc powder: the thermosetting resin: the zinc stearate powder was set to be 81:13:5:1.

Next, a 4.5-turn coil with two levels whose inner diameter was 5.5 mm was prepared using a 1-mm diameter coated copper wire. Using a mold 12.5 mm square, samples were produced with the copper wire by the same method as in Example 12. The molded body thus obtained had a size of 12.5×12.5×3.4 mm and a packing ratio of the metallic magnetic powder of 78%. Inductances of this magnetic element measured at 0 A and 20 A were high, namely 1.4 μH and 1.2 μH, respectively, and had low current value dependence. Next, a coil terminal and an element outer face, and two places on the element outer face were clamped with alligator clips, respectively. Then, the electrical resistances between the coil terminal and the element outer face and between two points on the element outer face were measured. As a result, in both the cases, a resistance of at least $10^8$ Ω was obtained and in addition, the withstand voltage was at least 400V. Thus, the coil terminal and the element outer face and the two points on the element outer surface were electrically insulated perfectly from each other. The electrical resistance of the coil conductor itself was 3.0 mΩ.

Example 15

In this example, Fe-3% Al powder with a mean particle size of 13 μm was prepared as a metallic magnetic powder. To this powder, 4 wt % epoxy resin indicated in Table 9 was added, which then was mixed sufficiently. The mixture was treated under the conditions indicated in Table 9 and then was granulated to be granules with a particle size of 100 to 500 μm by being passed through a mesh. In Table 9, epoxy resin treated under the treatment condition of "dissolution in MEK" was used by being pre-dissolved in a methyl ethyl ketone solution with a weight that is 1.5 times the weight of the epoxy resin. The solid-powder-state epoxy resin (in which the principal component was in a powder state but a curing agent was in a liquid state) used herein had a mean particle size of about 60 μm.

Next, a 4.5 turn coil (having a thickness of about 2 mm and a DC resistance of 3.0 mΩ) with two levels whose inner diameter was 5.5 mm was prepared using a 1-mm coated lead wire. Respective powders indicated in Table 9 were pressure-molded in a mold at various pressures around 3.5 t/cm$^2$ (about 343 MPa) so that this coil was contained inside each molded body thus obtained. The molded body was taken out from the mold and then was heat-treated at 150° C. for one hour, and thereby the thermosetting resin was cured. Thus, 12.5-mm square samples with a thickness of 3.5 mm were produced. For comparison, powders that were not heat-treated and were not granulated also were prepared and samples were produced with such powders by the same method. Inductances of these samples at a DC bias current of 0 A and 20 A were measured at 100 kHz. The results are shown in Table 9.

TABLE 9

| No. | Resin State | Treatment Condition | Heating Condition ° C. - 30 Min. | Granulation | Powder Flowability* | Inductance (μH) 0A | Inductance (μH) 20A |
|---|---|---|---|---|---|---|---|
| 1 | Liquid | — | None | Done | C | 1.8 | 1.5 |
| 2 | Liquid | — | 50 | Done | C | 1.7 | 1.4 |
| 3 | Liquid | — | 65 | Done | A | 1.6 | 1.4 |
| 4 | Liquid | — | 80 | Done | A | 1.5 | 1.3 |
| 5 | Liquid | — | 100 | Done | A | 1.4 | 1.2 |
| 6 | Liquid | — | 150 | Done | A | 1.2 | 1.0 |
| 7 | Liquid | — | 170 | Done | A | 0.9 | 0.8 |
| 8 | Liquid | — | 100 | Without | B | 1.3 | 1.1 |
| 9 | Powder | — | None | Done | B | 1.5 | 1.3 |
| 10 | Powder | — | 100 | Done | A | 1.2 | 1.0 |
| 11 | Powder | — | 100 | Without | B | 1.1 | 0.9 |
| 12 | Powder | Dissolution in MEK | None | Done | B | 0.9 | 0.8 |
| 13 | Powder | Dissolution in MEK | 100 | Done | A | 0.9 | 0.8 |
| 14 | Powder | Dissolution in MEK | 100 | Without | B | 0.8 | 0.7 |

*A: good, B: a little poor, C: poor

As is apparent from Table 9, in the samples Nos. 1 and 2 produced using liquid resin without the heat treatment or with the heat treatment at low temperature, high inductance values were obtained, but the flowability of the powder was extremely low. Consequently, the samples 1 and 2 had a disadvantage in that it was difficult to fill the mold with the powder in an actual production. In the samples Nos. 3 to 6 that were pre-heated at a temperature between 65° C. and 150° C. of the main curing temperature of the resin and were granulated, flowability of the powder was excellent and in addition, inductance values were sufficiently high for practical use. The sample No. 7 that was pre-heated at 170° C. had lower inductance values. Furthermore, the sample No. 8 that was pre-heated but was not granulated had slightly lower flowability but was able to be used.

When using powder resin, even when the pre-heating and granulation treatments were omitted, a certain degree of flowability was obtained. However, better flowability was obtained when such treatments were carried out. When a comparison was made between liquid resin and powder resin, lower inductance values were obtained in the case of using the powder resin overall. Particularly, the samples Nos. 12 to 14 in which the resin was dissolved in MEK temporarily had lower inductance values overall.

As described above, the present invention provides composite magnetic bodies with good characteristics and magnetic elements using the same such as an inductor, a choke coil, or a transformer. Thus, the present invention has a high industrial utility value.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A composite magnetic body, comprising:

metallic magnetic powder;

thermosetting resin and an electrical insulating material other than the thermosetting resin, wherein the composite magnetic body has a packing ratio of the metallic magnetic powder of 65 vol % to 90 vol % and an electrical resistivity of at least $10^4$ Ω·cm, and wherein the electrical insulating material contains at least one compound selected from an organic silicon compound, an organic titanium compound, and a silica-based compound.

2. The composite magnetic body according to claim 1, wherein the packing ratio of the metallic magnetic powder is 70 vol % to 85 vol %.

3. The composite magnetic body according to claim 1, wherein the metallic magnetic powder contains, as a main component, a magnetic metal selected from Fe, Ni, and Co and, as a subsidiary component, a non-magnetic element in a total amount not exceeding 10 wt %.

4. The composite magnetic body according to claim 1, wherein the metallic magnetic powder contains at least one non-magnetic element selected from Si, Al, Cr, Ti, Zr, Nb, and Ta.

5. The composite magnetic body according to claim 1, wherein the electrical insulating material comprises an oxide film formed on a surface of the metallic magnetic powder.

6. The composite magnetic body according to claim 5, wherein the oxide film contains at least one non-magnetic element selected from Si, Al, Cr, Ti, Zr, Nb, and Ta.

7. The composite magnetic body according to claim 6, wherein the oxide film has a thickness of 10 nm to 500 nm.

8. The composite magnetic body according to claim 1, wherein the electrical insulating material is a solid powder with a mean particle size not exceeding one tenth of that of the metallic magnetic powder.

9. The composite magnetic body according to claim 1, wherein the electrical insulating material is plate- or needle-like particles.

10. The composite magnetic body according to claim 9, wherein the plate- or needle-like particles have an aspect ratio of at least 3/1.

11. The composite magnetic body according to claim 9, wherein the plate- or needle-like particles have a mean largest-diameter of 0.2 to 3 times a mean particle size of the metallic magnetic powder.

12. The composite magnetic body according to claim 9, wherein the plate- or needle-like particles contain at least one selected from talc, boron nitride, zinc oxide, titanium oxide, silicon oxide, aluminum oxide, iron oxide, barium sulfate, and mica.

13. The composite magnetic body according to claim 1, wherein the electrical insulating material is at least one selected from fatty acid salt, fluororesin, talc, and boron nitride.

14. A magnetic element, comprising:

a composite magnetic body comprising metallic magnetic powder, thermosetting resin, and an electrical insulating material other than the thermosetting resin, the composite magnetic body having a packing ratio of the metallic magnetic powder of 65 vol % to 90 vol % and an electrical resistivity of at least $10^4$ Ω·cm; and a coil embedded in the composite magnetic body, wherein the electrical insulating material is formed in accordance with at least one of the following arrangements (a)–(d):

(a) the electrical insulating material contains at least one compound selected from an organic silicon compound, an organic titanium compound, and a silica-based compound;

(b) the electrical insulating material is a solid powder with a mean particle size not exceeding one tenth of that of the metallic magnetic powder:

(c) the electrical insulating material is plate- or needle-like particles; and (d) the electrical insulating material is at least one selected from fatty acid salt, fluororesin, talc, and boron nitride.

15. A composite magnetic body, comprising:

metallic magnetic powder;

thermosetting resin, and an electrical insulating material other than the thermosetting resin, wherein the composite magnetic body has a packing ratio of the metallic magnetic powder of 65 vol % to 90 vol % and an electrical resistivity of at least $10^4$ Ω·cm, and the electrical insulating material is a solid powder with a mean particle size not exceeding one tenth of that of the metallic magnetic powder.

16. The composite magnetic body according to claim 15, wherein the packing ratio of the metallic magnetic powder is 70 vol % to 85 vol %.

17. The composite magnetic body according to claim 15, wherein the metallic magnetic powder contains, as a main component, a magnetic metal selected from Fe, Ni, and Co and, as a subsidiary component, a non-magnetic element in a total amount not exceeding 10 wt %.

18. The composite magnetic body according to claim 15, wherein the metallic magnetic powder contains at least one non-magnetic element selected from Si, Al, Cr, Ti, Zr, Nb, and Ta.

19. A composite magnetic body, comprising:

metallic magnetic powder;

thermosetting resin, and an electrical insulating material other than the thermosetting resin, wherein the composite magnetic body has a packing ratio of the metallic magnetic powder of 65 vol % to 90 vol % and an electrical resistivity of at least $10^4$ Ω·cm, and the electrical insulating material is plate- or needle-like particles.

20. The composite magnetic body according to claim 19, wherein the packing ratio of the metallic magnetic powder is 70 vol % to 85 vol %.

21. The composite magnetic body according to claim 19, wherein the metallic magnetic powder contains, as a main component, a magnetic metal selected from Fe, Ni, and Co and, as a subsidiary component, a non-magnetic element in a total amount not exceeding 10 wt %.

22. The composite magnetic body according to claim 19, wherein the metallic magnetic powder contains at least one non-magnetic element selected from Si, Al, Cr, Ti, Zr, Nb, and Ta.

23. The composite magnetic body according to claim 19, wherein the plate-or needle-like particles have an aspect ratio of at least 3/1.

24. The composite magnetic body according to claim 19, wherein the plate- or needle-like particles have a mean largest-diameter of 0.2 to 3 times a mean particle size of the metallic magnetic powder.

25. The composite magnetic body according to claim 19, wherein the plate- or needle-like particles contain at least one selected from talc, boron nitride, zinc oxide, titanium oxide, silicon oxide, aluminum oxide, iron oxide, barium sulfate, and mica.

26. A composite magnetic body, comprising:

metallic magnetic powder;

thermosetting resin, and an electrical insulating material other than the thermosetting resin, wherein the composite magnetic body has a packing ratio of the metallic magnetic powder of 65 vol % to 90 vol % and an electrical resistivity of at least $10^4$ Ω·cm, and the electrical insulating material is at least one selected from fatty acid salt, fluororesin, talc, and boron nitride.

27. The composite magnetic body according to claim 26, wherein the packing ratio of the metallic magnetic powder is 70 vol % to 85 vol %.

28. The composite magnetic body according to claim 26, wherein the metallic magnetic powder contains, as a main component, a magnetic metal selected from Fe, Ni, and Co and, as a subsidiary component, a non-magnetic element in a total amount not exceeding 10 wt %.

29. The composite magnetic body according to claim 26, wherein the metallic magnetic powder contains at least one non-magnetic element selected from Si, Al, Cr, Ti, Zr, Nb, and Ta.

* * * * *

UNITED STATES PATENT AND TRADEMARK OFFICE

CERTIFICATE OF CORRECTION

PATENT NO. : 6,784,782 B2
DATED : August 31, 2004
INVENTOR(S) : Inoue et al.

It is certified that error appears in the above-identified patent and that said Letters Patent is hereby corrected as shown below:

Column 29,
Line 40, "thermosetting resin and" should read -- thermosetting resin, and --

Signed and Sealed this

Seventh Day of June, 2005

JON W. DUDAS
*Director of the United States Patent and Trademark Office*